US008366413B2

(12) United States Patent
Corbeil

(10) Patent No.: US 8,366,413 B2
(45) Date of Patent: Feb. 5, 2013

(54) LOW RATE HYDRAULIC ARTIFICIAL LIFT

(76) Inventor: Jason Corbeil, Red Deer (CA)

( * ) Notice: Subject to any disclaimer, the term of this patent is extended or adjusted under 35 U.S.C. 154(b) by 521 days.

(21) Appl. No.: 12/464,696

(22) Filed: May 12, 2009

(65) Prior Publication Data

US 2009/0285700 A1 Nov. 19, 2009

Related U.S. Application Data

(60) Provisional application No. 61/052,901, filed on May 13, 2008.

(51) Int. Cl.
*F04B 35/02* (2006.01)

(52) U.S. Cl. ..... 417/390; 417/555.1; 417/555.2

(58) Field of Classification Search ..... 417/390, 417/555.1, 555.2, 904; 166/369
See application file for complete search history.

(56) References Cited

U.S. PATENT DOCUMENTS

| | | | | |
|---|---|---|---|---|
| 4,172,670 | A * | 10/1979 | Welker | 366/332 |
| 7,380,608 | B2 * | 6/2008 | Geier | 166/369 |
| 2008/0003121 | A1 * | 1/2008 | Scallen | 417/423.3 |

FOREIGN PATENT DOCUMENTS

| | | |
|---|---|---|
| CA | 2260518 | 8/1999 |
| CA | 2258237 | 7/2000 |

* cited by examiner

*Primary Examiner* — Karabi Guharay
(74) *Attorney, Agent, or Firm* — Sander Gelsing

(57) ABSTRACT

In an embodiment of the invention, a down-hole pump comprises a hydraulic chamber having a passage for fluid communications with a hydraulic conduit, a produced fluid chamber having an inlet and an outlet, a first check valve associated with the inlet, a second check valve associated with the outlet, a stored energy unit, a piston, having one side exposed to the stored energy unit and a second side exposed to the hydraulic chamber and a displacement member projecting from said piston into the produced fluid chamber. Additional embodiments and aspects, including embodiments for power units as well as system and method aspects, are also disclosed.

8 Claims, 5 Drawing Sheets

LOW RATE HYDRAULIC ARTIFICIAL LIFT

CROSS REFERENCE TO RELATED APPLICATION

This application is a regular application of U.S. Provisional Patent Application Ser. No. 61/052,901 filed May 13, 2008 and entitled, "LOW RATE HYDRAULIC ARTIFICIAL LIFT", the entirety of which is incorporated herein by reference.

FIELD OF THE INVENTION

The field of present invention relates generally to systems for pumping fluid out of producing oil and gas wells. More specifically, the invention is directed to a system which includes a hydraulic driven down-hole pump for pumping various wellbore fluids to surface.

BACKGROUND OF THE INVENTION

Many low pressure and near depleted oil and gas wells have a low fluid production rate (1-5 $m^3$/day). This complicates cost effective removal of such fluid, including potential damage to a pump due to dry pumping.

Down-hole hydraulic pumps with the valving, piston and pump (and its variations) were originally developed under the trade names "Kobe" and "Oilmaster". Both have been available to the industry for more than five decades. These pumps find special application lifting large volumes of light oil in deep wells.

More recently, Canadian application 2,258,237 by Cunningham suggested bringing the valving to the surface, and proposed using a downhole double acting hydraulic piston, three (3) strings of tube and a conventional oil well pump for placement in a horizontally drilled heavy oil well. The double acting feature of the hydraulic piston would be particularly useful as a pump pull-down in the highly viscous heavy oil applications for which the system was conceived. Canadian patent 2,260,518, also by Cunningham, proposes using a down-hole rotary hydraulic drive, coupled to a progressing cavity pump rather than the reciprocating version suggested by the earlier Cunningham application. Both address the task of pumping heavy oil in deviated well-bores.

Even more recently, U.S. application 2006/0124298 by Geier teaches a method for dewatering a gas well where the water is pumped to surface by an inverted API pump acting as a reciprocating pump (the entirety of which is incorporated by reference herein). The design of Geier may suffer from a number of disadvantages, including those typically associated with API rod pumps (which are unable to run dry and therefore will require complex control systems to operate in low fluid production rate applications), appears overly complex (requiring additional components such as a counter balance chamber, multiple pistons, a charge of oil between some of the pistons, soft seal packs to prolong pump life and a traveling valve) and requires the use of a modified traveling barrel API sucker rod pump (which adds to the overall expense).

Additionally many fields of shallow gas wells are being produced by scheduled dewatering using service equipment such as blow downs or swabbing. Such traditional methods of dewatering are inefficient and don't maximize well production because, right after such dewatering treatment, the well will begin loading again with water, negatively affecting well production.

For example, swabbing may be scheduled on a weekly basis for a gas well which produces about a cubic meter ($m^3$, i.e. 1000 L) of water per day. Well production will be maximized shortly after swabbing, but then as water builds or loads up in the wellbore, production will decrease to a low level until the next scheduled swabbing event. This cyclic water loading (and associated decrease in production rates) creates inefficiencies in the well's overall production.

What is therefore desired is a novel submersible pump arrangement for use with low rate fluid inflow, which overcomes the limitations and disadvantages of the existing arrangements, which removes wellbore fluids as they accumulate (rather than only at scheduled times), which has a low installation and purchase cost and which will eliminate the need for expensive scheduled dewatering operations such as blow downs or swabbing.

SUMMARY OF THE INVENTION

In one aspect of the invention there is provided a down-hole pump, the pump comprising a hydraulic chamber having a passage for fluid communications with a hydraulic conduit, a produced fluid chamber having an inlet and an outlet, a first check valve associated with the inlet, a second check valve associated with the outlet, a stored energy unit, a piston, having one side exposed to the stored energy unit and a second side exposed to the hydraulic chamber and a displacement member projecting from said piston into the produced fluid chamber.

In another aspect of the invention there is provided a power unit to provide hydraulic force to a hydraulic fluid so as to operate a hydraulically driven apparatus, the power unit comprising a hydraulic pump, a reservoir capable of holding a quantity of said hydraulic fluid, hydraulic valving to divert flow of hydraulic fluid to either the hydraulically driven apparatus or the reservoir and a controller to actuate the hydraulic valving at a predetermined interval.

In a system aspect of the invention, there is provided an artificial lift system comprising a down-hole pump and a power unit. The down-hole pump comprises a hydraulic chamber having a passage for fluid communications with a hydraulic conduit, a produced fluid chamber having an inlet and an outlet, a first check valve associated with the inlet, a second check valve associated with the outlet, a stored energy unit, a piston, having one side exposed to the stored energy unit and a second side exposed to the hydraulic chamber and a displacement member projecting from said piston into the produced fluid chamber. The power unit comprises a hydraulic pump, a reservoir capable of holding a quantity of said hydraulic fluid, hydraulic valving to divert flow of hydraulic fluid to either the hydraulically driven apparatus or the reservoir and a controller to actuate the hydraulic valving at a predetermined interval.

In a method aspect of the invention, a method of pumping wellbore fluid from a down-hold location is provided. The method comprises the steps of providing a power unit at the surface location for generating a flow of hydraulic fluid under pressure, providing at the down-hole location a pump having a chamber and a piston therein, providing at the down-hole location a stored energy unit having back pressure therein, wherein a first side of the piston is exposed to said back pressure, providing a hydraulic conduit extending from the power unit at the surface location to the pump on a second side of the piston therein, providing at the down-hole location a produced fluid chamber having an inlet and an outlet and having a check valve associated with each of said inlet and outlet, providing at the down-hole location a rod for creating a displacement in the produced fluid chamber, providing a second conduit from the outlet of the produced fluid chamber to the surface location, causing the power unit to generate a flow in the hydraulic fluid on said second side of the piston to drive the piston from a start position to an end position and forcing said first side of the piston against the back pressure, causing the movement of the piston to drive the rod through an intake stroke to draw in the fluid into the produced fluid chamber and at the end of the intake stroke of the rod, releasing pressure in the hydraulic fluid in the hydraulic conduit so as to cause the back pressure of the stored energy unit to drive the piston back to the start position, causing the piston to drive the rod through a discharge stroke to displace wellbore fluid from the produced fluid chamber through the second conduit to the surface location. Additional embodiments and aspects are also disclosed.

BRIEF DESCRIPTION OF THE DRAWING FIGURES

Embodiments of the invention will now be described, by way of example only, with reference to the accompanying drawings, wherein.

Figure 1:
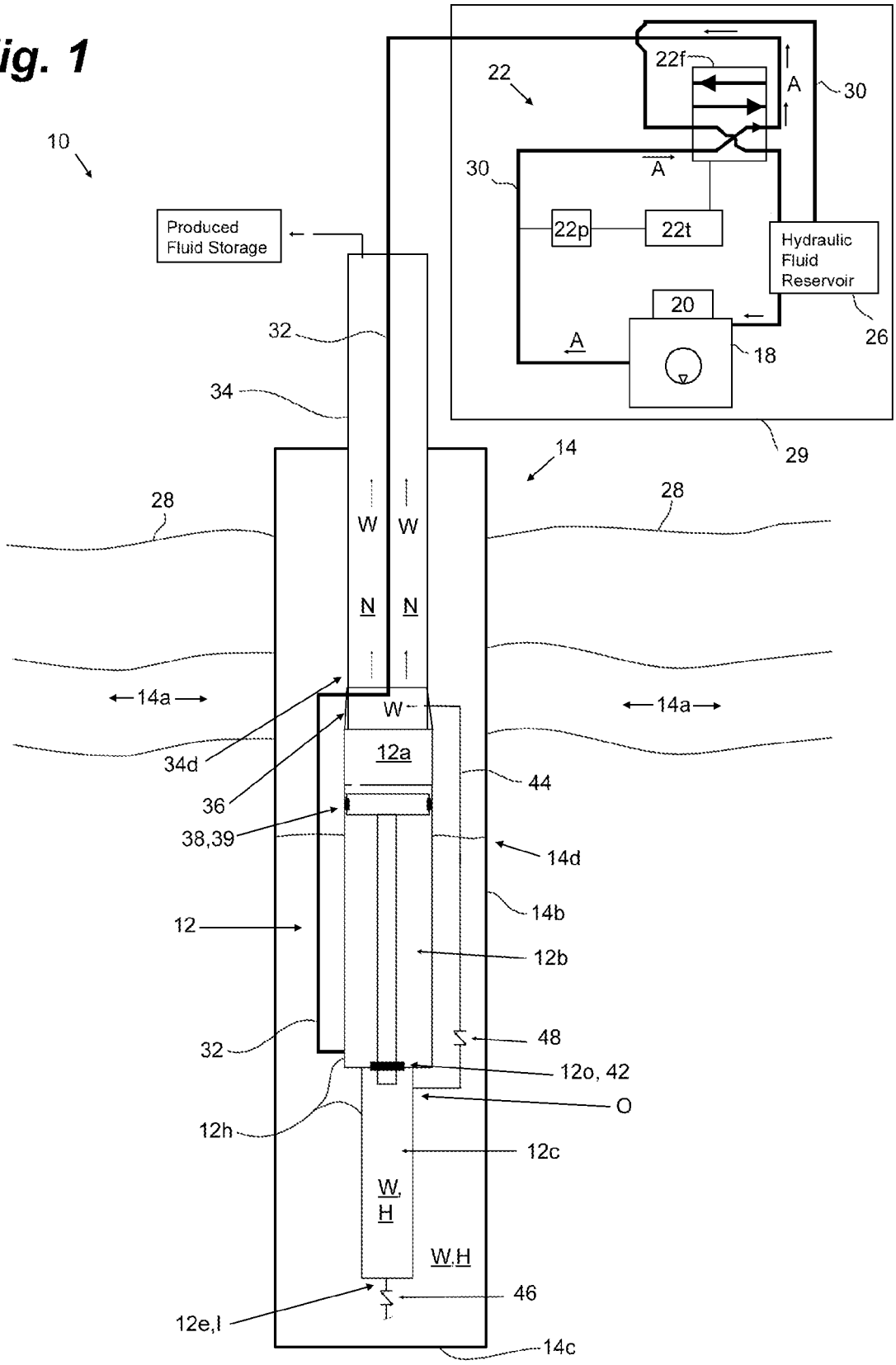
FIG. 1 is a schematic view, partially in vertical cross-section, of a system according to the present invention which is used for pumping wellbore fluids from a well.
Figure 4A:
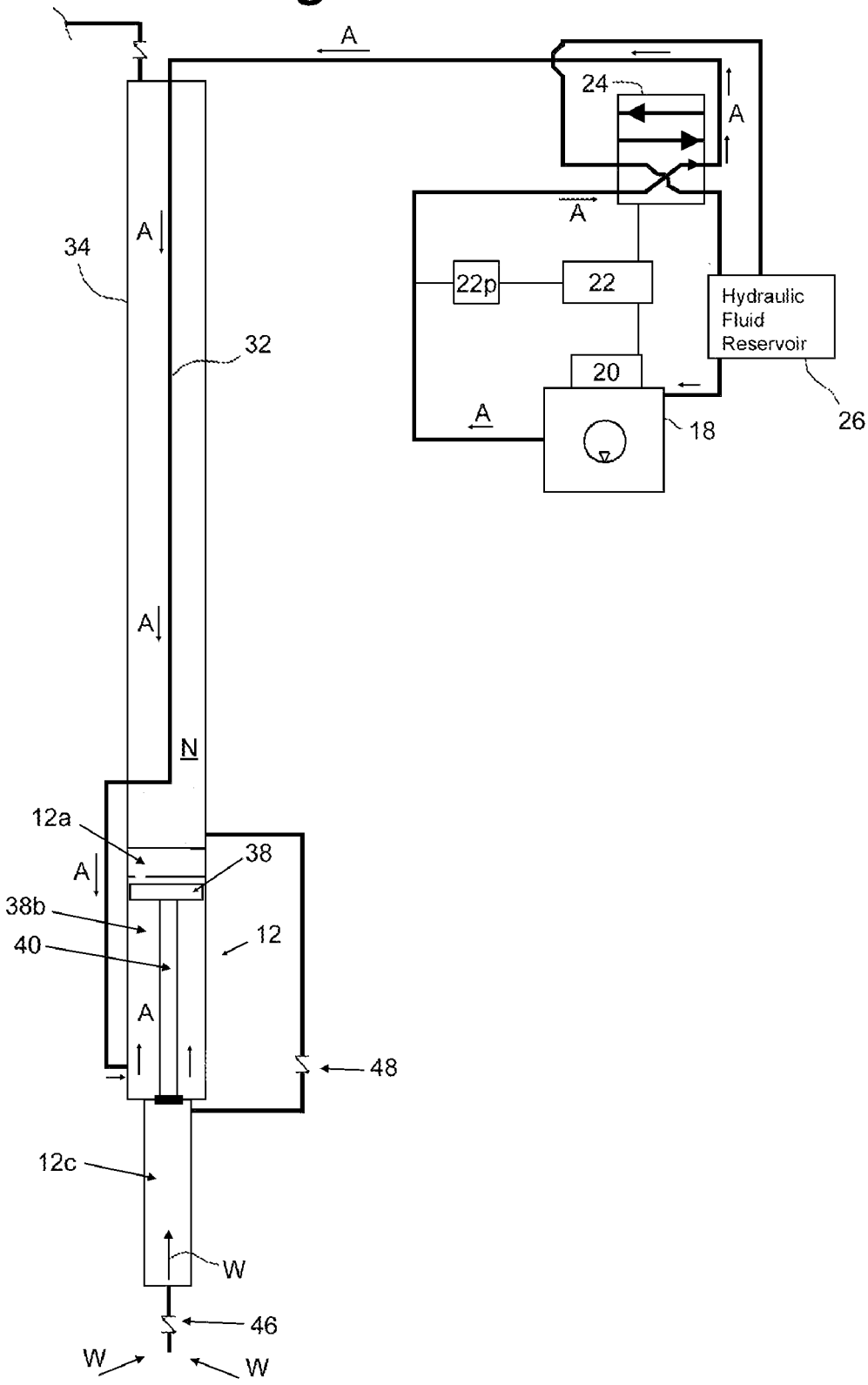
Figure 4B:
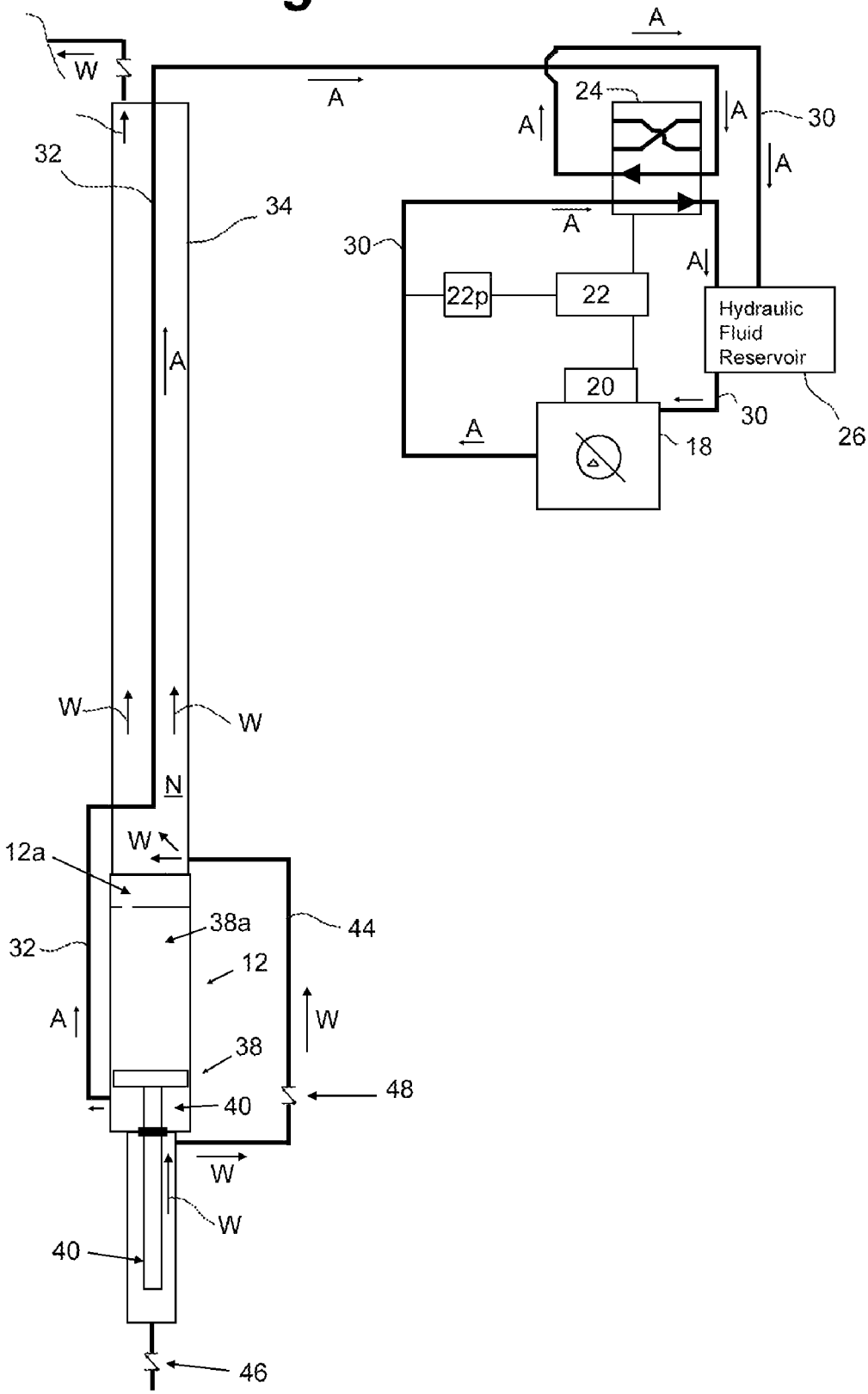
Figure 5:
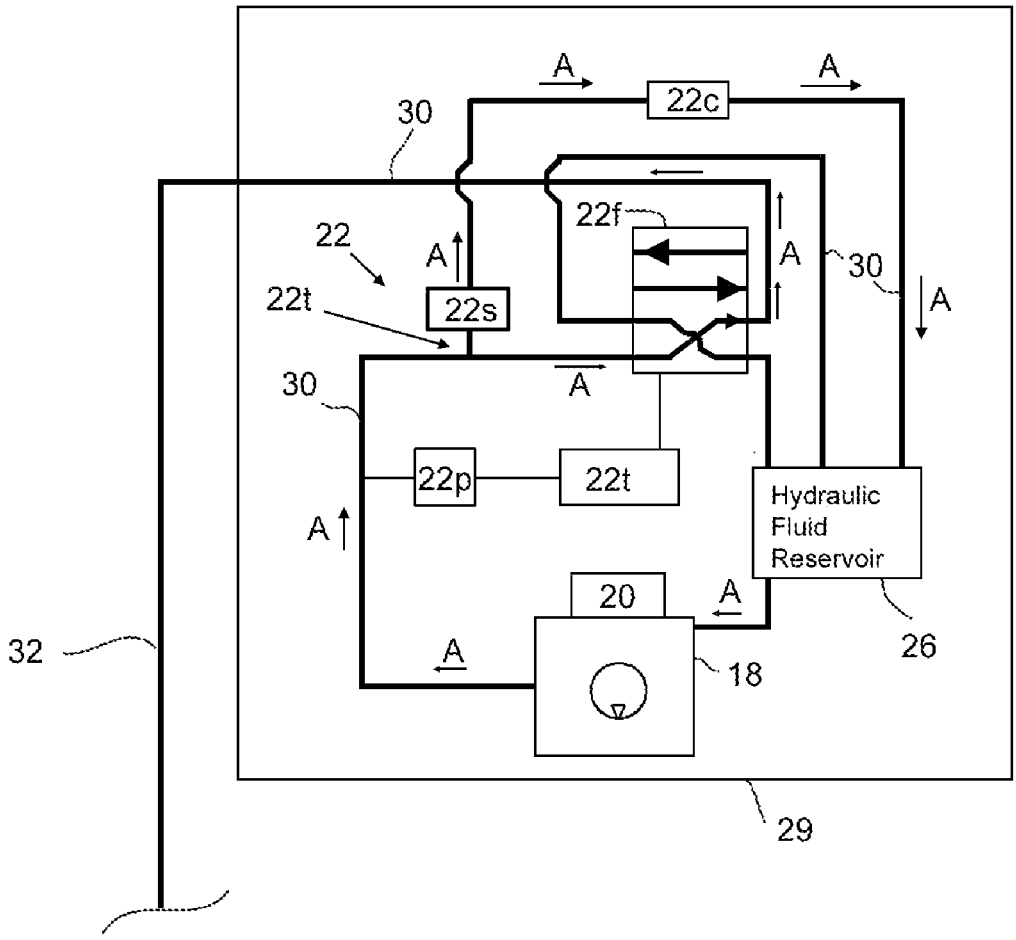

FIGS. 4*a*-4*b* are schematic views, partially in vertical cross-section, of the system of FIG. 1 showing the hydraulic valving in different positions so as to have the pump achieve either a fluid intake stroke or a discharge stroke; and FIG. 5 is a schematic view of another embodiment of a power unit.

DETAILED DESCRIPTION OF THE PREFERRED EMBODIMENTS

The following description are of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

This invention relates to an artificial lift system 10 for pumping wellbore fluids W, such as water H, out of oil and gas wells. More specifically, the invention includes a hydraulic driven down-hole pump 12 of novel design. It will be understood that while the down-hole pump 12 is designed to pump a variety of wellbore fluids W, such as oil or water H, to the surface, it can also be used to pump any other fluid of interest in applications other than in a wellbore.

The well is generally indicated at 14 and includes a oil or gas formation 14*a* and a well casing 14*b* for transporting oil or gas to the surface for collection in conventional manner. The structure of the well casing 14*b* and the oil or gas formation 14*a* are shown only schematically as these are well known to a person skilled in the art.

As is well known, wellbore fluids W such as water H tends to collect at a lower end 14*c* of the well casing 14*b*. In instances where the well 14 is a gas well, water H can increase in depth to a situation where the water H interferes with the production of gas from the formation 14*a* due to hydrostatic load. In such cases, the intention is that the water level be maintained below the gas formation at a water level 14*d*.

Referring to FIG. 1, which shows a schematic of the artificial lift system 10 according to one embodiment the present invention, the artificial lift system 10 comprises a novel hydraulically driven down-hole pump 12 (shown in more detail in various views in FIGS. 2 through 4*b*), a hydraulic pump 18, a drive unit 20, a controller 22, hydraulic valving 22*f*, a hydraulic fluid reservoir 26 and a sufficient quantity hydraulic fluid A.

Preferably, the hydraulic pump 18 is a RONZIO™ gear pump having a displacement of 0.264 cubic inches per revolution manufactured by Ronzio Oleodinamica of Milan, Italy. More preferably, the drive unit 20 is a combustion engine running on casing or wellhead gas. Alternatively, in another embodiment (not shown), the drive unit 20 is an electric motor.

In this embodiment the controller 22 comprises a timer 22*t* and a pressure sensor 22*p*. Preferably, the timer 22*t* is an Allen Bradley™ model 700 HR timer manufactured by Rockwell Automation, Inc. of Milwaukee, Wis., United States of America. In another embodiment (not shown) the controller 22 is a programmable logic controller. Further, in this embodiment the hydraulic valving 22*f* is a two-position, four-way valve. Preferably, the two-position, four-way valve is a HYDRAFORCE™ SV10 valve manufactured by Hydraforce, Inc. of Lincolnshire, Ill., United States of America.

Preferably, the hydraulic fluid reservoir 26 is a ten (10) gallon container kept about half full with hydraulic fluid A during operation. Even more preferably, a visual sight glass (not shown) is provided on the reservoir 26. Advantageously, such a visual sight glass allows for an operator of the system 10 to obtain visual confirmation of the system's operations (as the hydraulic fluid A raises and lowers within the reservoir 26 during pump 12 operations).

The hydraulic pump 18 is powered by the drive unit 20. The hydraulic valving 22*f* is controlled and actuated by controller 22 (in this embodiment the timer 22*t* and pressure sensor 22*p*). The hydraulic pump 18 is operably coupled to the hydraulic valving 22*f* via a conduit 30. The hydraulic fluid reservoir 26 is associated with conduit 30. The hydraulic pump 18, the valving 22*f*, the reservoir 26 and the conduit 30 are in fluid communication with each other. The down-hole pump 12 is operably coupled to the hydraulic valving 22*f* via a length of hydraulic conduit 32, which in turn is in fluid communication with conduit 30. In this embodiment, the pressure sensor 22*p* detects the pressure of the hydraulic fluid A in hydraulic conduit 30 and, depending on the particular setting of the valving 22*f*, also the pressure in conduit 32. In another embodiment (not shown) the pressure sensor 22*p* detects the pressure of the hydraulic fluid A in hydraulic conduit 32 directly.

Still referring to FIG. 1, the hydraulic pump 18 is shown using a symbol indicating the pump 18 functions as a unidirectional hydraulic pump, wherein subsequent flow direction is achieved using the valving 22*f* to deliver hydraulic fluid A to either the hydraulic pump 12 or the hydraulic reservoir 26. It will be understood that the valving 22*f* and one way hydraulic pump 18 can be replaced with, for example, a bidirectional hydraulic pump such as, but not limited to, a bidirectional variable displacement hydraulic pump.

The hydraulic pump 18, the drive unit 20, the controller 22, the hydraulic valving 22*f* and the hydraulic fluid reservoir 26 could, for example, be sited on a small skid (not shown)

located on the surface 28 or in a suitable space below ground. Together the hydraulic pump 18, the drive unit 20, the controller 22, the hydraulic valving 22*f* and the hydraulic fluid reservoir 26 comprise a power unit 29 which provides hydraulic force to operate the downhole pump 12.

Preferably, the hydraulic conduit 32 is a ½ inch (12.5 mm) outside diameter (O.D.) stainless steel continuous tubing. More preferably, the hydraulic fluid A is a low viscosity, low density hydraulic oil such as NUTO™ A 10 sold by Imperial Oil Limited. Advantageously, a low viscosity hydraulic oil facilitates movement of the fluid A through a small diameter hydraulic conduit 32, while keeping the pressure required to move said fluid A lower, as compared to a higher viscosity fluid that is typically used in a conventional hydraulic system.

The inventor has observed that using the NUTO™ A 10 hydraulic oil in the artificial lift systems 10 on a 1200 meter deep well 14 and with an approximately 1200 meter long ½" O.D. stainless steel hydraulic conduit 32 resulted in hydraulic fluid pressures in the range of 2600 psi to 2850 psi. In contrast, the inventor observed that using conventional ISO 32 weight hydraulic oil required pumping pressures in excess of 5000 psi to move the hydraulic fluid A through an approximately 1200 meter long ½" O.D. stainless steel hydraulic conduit 32. A system 10 using such ISO 32 weight hydraulic oil requires more energy to run (as compared to the NUTO™ A 10 hydraulic oil) and also requires component and parts, such as tubing and valving, rated for the higher (e.g. 5000 psi) pressures. These higher pressure rated components tend to be more expensive than conventional components and parts rated for 3000 to 3500 psi.

Downhole Pump:

In this embodiment, the down-hole pump 12 is connected to the down-hole end 34*d* of a tubular member 34 via connector 36. Preferably the tubular member 34 is a coiled tubing (CT) string in the range of 38.1 mm (1½ inches) to 44.5 mm (1¾ inches) outside diameter coiled tubing string. More preferably hydraulic conduit 32 is placed concentrically with tubular member 34, thereby forming an annulus N between the inside passage of the tubular member 34 and the outside diameter of hydraulic conduit 32. Advantageously, the annulus N can be utilized as a passage or conduit to transport wellbore fluids W, pumped by the downhole pump 12, to surface. Even more preferably, connector 36 is ported to accommodate passage of the hydraulic conduit 32 therethrough to connect within the pump 12. Alternatively, the connector 36 is ported to accommodate hydraulic fluid A passage from the hydraulic conduit 32 to the pump 12 and the connector 36 is capable of isolating the annulus N between the inside passage of the tubular member 34 and the hydraulic conduit 32 from the inside passage of the hydraulic conduit 32. Yet even more preferably, the connector 36 has a bottom threaded section for threadable connection to the pump 12 and a top SWAGLOK™ connection section for connection to the tubular member 34. In an alternate embodiment (not shown) the connector 36 is welded to the end of the tubular member 34. In yet an alternate embodiment (also not shown) tubular member 34 has a threaded end for threadable engagement directly with a matching threaded end on the pump 12 and no connector is utilized.

Advantageously, by running the pump 12 on endless tubing such as coiled tubing strings, operational costs are kept down as compared to running the pump 12 on a conventional jointed pipe (as there is no need to connect each length of pipe to the string). More advantageously the hydraulic conduit 32 can be concentrically placed within a length of coiled tubing 34 prior to operations and both can be transported in a coiled state (i.e. with conduit 32 inside member 34). Even more advantageously, any coil unit can pull and run the down-hole pump 12. Yet even more advantageously, any pre-existing siphon or velocity strings in a well 14 may be used as the tubular member 34, thereby reducing operating costs for the system 10.

Figure 2:
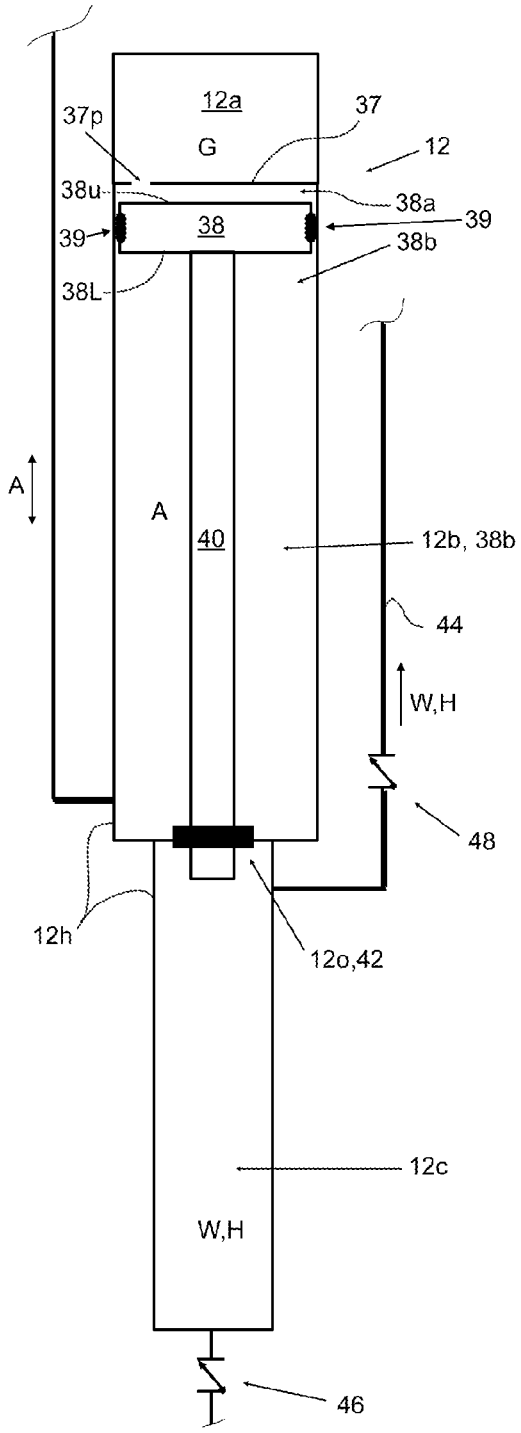
FIG. 2 shows a longitudinal cross-section schematic along the vertical plane of a down-hole pump, according to the present invention, at 100% fluid intake stroke configuration.
Figure 3:
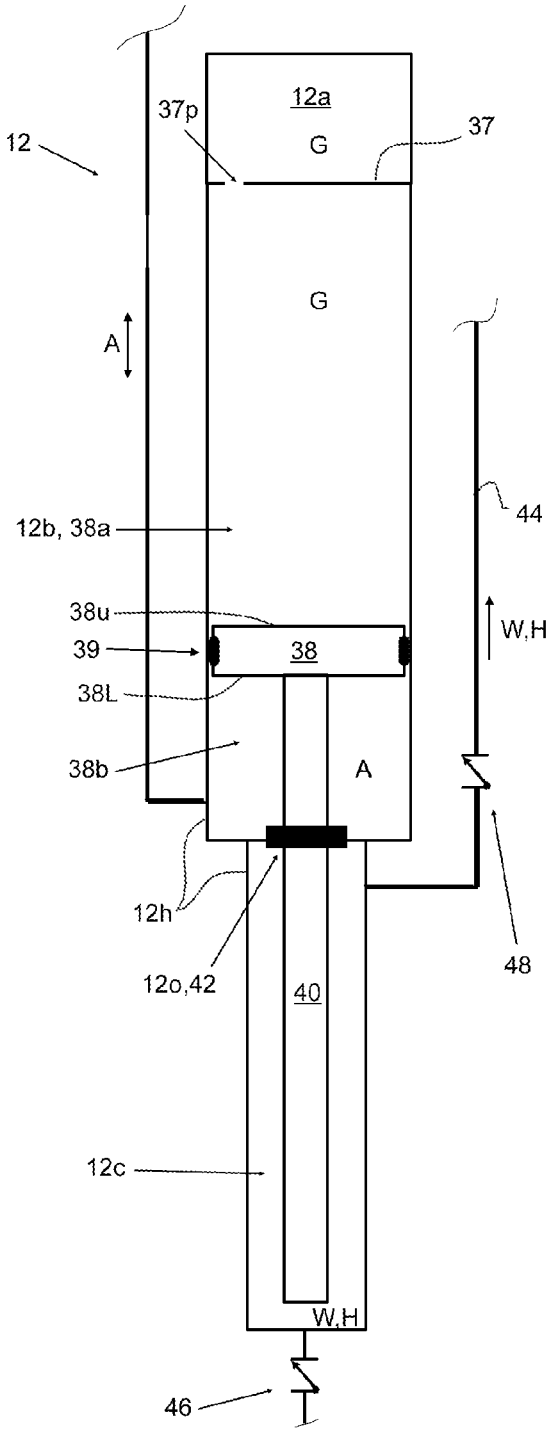
FIG. 3 shows a longitudinal cross-section schematic along the vertical plane of a down-hole pump of FIG. 2, at 100% discharge stroke configuration.

The power unit 29, including the controller 22 and hydraulic valving 22*f*, is set up in a manner that the flow of hydraulic fluid A can be diverted to the down-hole pump 12 so as to actuate a fluid intake stroke of the down-hole pump 12 (see FIG. 2) or divert flow of hydraulic fluid A, from hydraulic conduit 32, into the hydraulic reservoir 26 so as to allow the pump 12 to return to a discharge position (see FIG. 3).

Referring now to FIGS. 1 through 3, which show a lengthwise cross-section view of the pump 12 according to the present invention, the pump 12 comprises a cylindrical housing 12*h* which is divided into three cylindrical chambers 12*a*, 12*b* and 12*c* stacked one on top another and sized to fit a given well casing internal dimension. Each chamber 12*a*, 12*b*, 12*c* is connected to the other in a conventional manner, such as by threaded subs or by being welded together. Each connection is internally ported to accommodate various fluid or component passage therethrough as may be required. Alternatively, in another embodiment (not shown), some of the chambers 12*a*, 12*b*, 12*c* can manufactured into a single cylindrical unit, thereby reducing the number of connections (e.g. chambers 12*a* and 12*b* as a single cylindrical unit).

Chamber 12*a* and chamber 12*b* are substantially separated from each other by a ported bulkhead or piston stop 37 wherein passage 37*p* provides for fluid communication between chambers 12*a* and 12*b*. Chamber 12*b*, may be referred to as a piston chamber and is divided by piston 38 into opposed chambers 38*a* and 38*b*. Preferably, piston 38 further comprises a piston seal 39 that travels with the piston 38. Preferably, the piston seal 39 is a PARKER PSP™ bidirectional "squeeze" type seal distributed by Parker Intangibles LLC of Denver, Colo., United States of America. Advantageously, by using only a sole piston, the pump's design is kept simple and inexpensive (as compared to the pump of Geier, shown in U.S. application 2006/0124298, which has multiple pistons, including two free pistons).

Preferably, the inside surface of chamber 12*b* is microhoned to facilitate sealing engagement of traveling piston seal 39. Chambers 12*a* and 38*a* may collectively be referred to as a stored energy chamber. Chamber 38*b* may be referred to as a hydraulic chamber and chamber 12*c* may be referred to as a produced fluid chamber. Chamber 12*b* and chamber 12*c* are substantially separated from each other in a conventional manner, with the exception of rod opening 12*o*.

A rod 40 projects from one side 38L of the piston 38 into chamber 38*b* and also into produced fluid chamber 12*c*, through rod opening 12*o*. Side 38L of the piston provides a surface area for the hydraulic fluid A of the power unit 29 to act against. The other side 38*u* of the piston 38 is exposed to stored energy in the stored energy unit 12*a*. In this embodiment, rod 40 is preferably 70 inches long with a 48 to 50 inch stroke into produced fluid chamber 12*c*.

Preferably rod 40 has an outside (O.D.) diameter of 1¼ inches while the inside diameter of produced fluid chamber 12*c*, which receives one end of rod 40, is preferably $1\frac{5}{16}^{th}$ inches. Advantageously, such a close or tight tolerance (between the outside diameter of the rod 40 and the inside diameter of the produced fluid chamber 12*c*) maximizes the compression ratio of the pump 12, allows the pump 12 to also pump gas (in addition to liquids) and thereby eliminates, or reduces the chance of, gas lock. More advantageously, the lack of mechanical contact between the rod 40 and the inside of the produced fluid chamber 12*c* reduces pump wear and allows the pump 12 to run dry without damage.

Preferably, piston 38 and rod 40 are constructed to seal under high internal pressure 3,000 to 3,500 psi both inside chamber 12*b* (for piston 38) and at rod opening 12*o* (through which rod 40 passes); thereby preventing the hydraulic fluid A, in hydraulic chamber 38*b*, from entering either of the stored energy chamber or the produced fluid chamber 12*c*. Preferably a rod seal 42 is positioned at the rod opening 12*o* to assist in sealing the rod 40 as it reciprocates through the opening 12*o* during operation. Preferably, the rod seal 42 is a PARKER POLYPAK™ lip seal distributed by Parker Intangibles LLC of Denver, Colo., United States of America. Advantageously, rod seal 42 also functions to wipe abrasive solids from the exposed portion of the rod 40 that projects into chamber 12*c*, as the rod 40 moves back into chamber 12*b*, through rod opening 12*o*, during a fluid intake stroke. More advantageously, all of the downhole pump's seals (i.e. both the traveling piston seal 39 and the rod seal 42) have portions exposed to hydraulic fluid A, thus lubricating the seals 39, 42 and further facilitating the pump 12 to run dry (i.e. without any wellbore fluids A in the produced fluid chamber 12*c*).

Further, in this embodiment, produced fluid chamber 12*c* comprises an inlet I which is associated with a first check valve 46 that only allows wellbore fluid W to enter chamber 12*c* (e.g. such as fluid W from the lower end 14*c* of the well casing 14*b*) and an outlet O associated with a second check valve 48 that only allows fluid W to exit the chamber 12*c*. Outlet O connects to the tubular member 34 via conduit 44 and, hence, produced fluid chamber 12*c* is in fluid communication with the annulus N, with second check valve 48 providing for only a one way flow of fluid W from produced fluid chamber 12*c* into the annulus N. Preferably, both check valves 46, 48 are standing (i.e. non-traveling) check valves, thereby reducing the need for seals associated with such traveling valves and further facilitating the pump's ability to run dry.

Advantageously, the outlet O is located as close to the connection with chamber 12*b* as possible so as to reduces or eliminate the chance of gas lock. More advantageously, because the pump's inlet I is located substantially near the end (of the pump 12) that is opposite to the end of the pump 12 that connects to the downhole end 34*d* of the tubular member 34, the pump 12 is able to draw in wellbore fluids W that might have collected at the lower end 14*c* of the well casing 14*b*. In contrast, the pump of Geier (shown in U.S. application 2006/0124298) has its inlet (item 10A) located close to the tubular member (item 27), with a number of pump components (such as hydraulic chamber and counter balance chamber) still depending further downward from Geier's inlet and, thus, Geier's pump is unable to draw in fluids from the lower end 14*c* of the casing.

In the embodiment of FIGS. 1-4*b*, chambers 12*a* and 38*a* are pre-charged with pressurized nitrogen gas G which acts as a stored energy unit to drive the piston 38 and, hence, the rod 40 into the produced water chamber 12*c*, so as to effect a positive displacement or discharge stroke in the pump 12. Preferably, the stored energy chamber is pre-charged with pressurized nitrogen gas G, and hydraulic chamber 38*b* is pre-charged with hydraulic fluid A, and both chambers are then purged of air pockets. The pressure of the nitrogen gas G used in the stored energy chamber is a technical calculation based on the hydrostatic pressure head of the hydraulic fluid A in the hydraulic chamber 38*b*, the hydrostatic pressure head of the wellbore fluid W in the annulus N, plus an additional amount to over-pressure and bottom out the piston 38 during the discharge stroke, taking into account such variables as depth of the pump 12 in the well 14 and the desired rate at which the rod 40 is to be reciprocated.

In another embodiment (not shown), disc springs, such as those manufactured by Belleville Springs Ltd. of REDDITCH Worcs, United Kingdom are loaded in the axial direction in chambers 12*a* and 38*a* to function act as a stored energy unit (instead of nitrogen gas). In yet another embodiment (not shown), coil springs are utilized, instead of disc springs, as the stored energy unit. In yet another embodiment (not shown), a compressible rubber member is utilized, instead of nitrogen gas, as the stored energy unit.

Advantageous, a low density hydraulic fluid A, such as NUTO™ A 10, reduces the hydraulic fluid's hydrostatic pressure and therefore requires a lower amount of stored energy in the stored energy unit to return the piston 38 and rod 40 back to the discharge position.

Operation:

In general the system 10 operates by the hydraulic pump 18 drawing hydraulic fluid A from the reservoir 26 and setting the valving 22*f* so as to supply hydraulic fluid A to the downhole pump's hydraulic chamber 38*b* (through the hydraulic conduit 32) so that the supply of fluid A to side 38L of the piston is of sufficient pressure and force to overcome the forces of fluid flow friction in the system 10 and the over-pressure in the stored energy chamber; at which point the piston 38, and hence the rod 40, are driven away from, and out of, the produced water chamber 12*c* effecting a fluid intake stroke in the produced fluid chamber 12*c* (see FIG. 4*a*). When the piston 38 reaches the upper end of its stroke (preferably being stopped by the piston stop 37) and completes its stroke, hydraulic fluid pressure will increase in the hydraulic conduit 32 and also in conduit 30 at surface 28 so as to generate a pressure spike. Advantageously, piston stop 37 also prevents the piston 38 from over traveling out of the rod opening 12*o*.

When the pressure spike is sensed by the pressure sensor 22*p*, the controller 22 actuates the two-position, four-way valve 22*f* so as to divert flow of hydraulic fluid A from the conduit 32 back into the hydraulic fluid reservoir 26, thereby releasing the pressure in conduit 32, while at the same time recirculating hydraulic fluid A from the pump 18 back into the reservoir 26 (see FIG. 4*b*). This release of pressure, in conduit 32, allows the stored energy (i.e. in this embodiment the pressurized nitrogen chambers 12*a* and 38*a*) to drive the piston 38 and, hence, the rod 40 into the produced water chamber 12*c*, effecting a fluid discharge or positive displacement stroke in the produced fluid chamber 12*c*; and forcing any wellbore fluids W in the produced water chamber 12*c*, through conduit 44 to the annulus N and to surface 28. Advantageously, if the piston 38 is stopped by the piston stop 37, a very definitive pressure spike is created, which then can be easily detected by the pressure sensor 22*p*.

Timer 22*t* is set at a predetermined interval to actuate the two-position four-way valve 22*f* back to the setting as shown in FIG. 4*a* and direct hydraulic fluid A, through the hydraulic conduit 32, back into the hydraulic chamber 38*b* of the pump 12, thereby initiating another fluid intake, or negative displacement, stroke; thereby starting the pumping cycle again. The controller 22, and timer 22*t*, can be set to the specifics of a particular well 14 where the system 10 is employed.

As the rod 40 is reciprocated into the produced fluid chamber 12*c*, a change in volumetric displacement occurs and, because of check valves 46, 48, this volumetric displacement forces wellbore fluid W through the conduit 44 into the annulus N of the coiled tubing string 34 and up to the surface 28 during the discharge stroke (see FIGS. 3 and 4*b*), while sucking or drawing in additional wellbore fluid W (if present) from the lower end 14*c* into the produced fluid chamber 12*c* during the fluid intake stroke (see FIGS. 2 and 4*a*). Thus the rod 40 acts as a displacement member.

Examples

For example, the inventor has observed that using the NUTO™ A 10 hydraulic oil in the artificial lift systems 10 of FIG. 1 on a 1200 meter deep well 14, and with an approximately 1200 meter long ½" O.D. stainless steel hydraulic conduit 32, the hydraulic fluid pressures will be in the range of 2600 psi to 2850 psi. Accordingly, when system 10 is actuated to create a fluid intake stroke (i.e. as per FIG. 4*a*), the pressure in the hydraulic fluid A becomes greater than this range, the system 10 over-pressures the stored energy unit and drives the piston 38 and rod 40 to an intake stroke.

In this example, an appropriate predetermined pressure spike then is in the range of 2900 psi. Wherein the hydraulic pump 18 is set to pump at a rate of approximately 3 U.S. gallons per minute, the inventor has observed that it takes approximate 48 seconds for the pressure spike to occur and that the first 30 seconds or so is consumed to "pressure up" the system so it can overcome the hydraulic fluid pressures in the conduit 32, before a fluid intake stroke is actuated. Detection of the pressure spike by the controller 22, once the piston 38 hits the piston stop 37, triggers the controller 22 to actuate the valve 22*f* to initiate a bleed-back of hydraulic fluid A, back into the reservoir 26, thereby initiating a discharge stroke (as shown in FIG. 4*b*).

The inventor has further observed that with a 1¼ inch outside diameter (O.D.) rod, having a 48 to 50 inch stroke into the produced water chamber 12*c*, positioned in a well 14 at approximately 1000 m depth, with a 30 second discharge stroke and a 24 second intake stroke, the system 10 was able to pump about 2000 liters (i.e. 2 cubic meters) of wellbore fluid W to surface in a day and that, with a 5 minute delay between discharge strokes, the system 10 pumps about 300 liters (i.e. 0.3 cubic meters) of wellbore fluid W to surface in a day.

Alternate Embodiment of Power Unit:

Referring now to FIG. 5, an alternate embodiment of the power unit 29 is illustrated. This embodiment is similar to the embodiment of the power unit 29 FIGS. 1-4*b*, but further comprises a sequence valve 22*s* and a flow control valve 22*c* connected in series by means of a section of conduit 30 (preferably with the flow control valve connected down stream from the sequence valve 22*s*). The sequence valve 22*s* and flow control valve 22*c* connect downstream from the hydraulic pump's 18 output by means of a t-joint 22*t* in the conduit 30, with the other branch of the t-joint 22*t* connecting to the two-position, four-way valve 22*f* (as more clearly shown in FIG. 5).

Preferably, the sequence valve 22*s* is a SUN HYDRAULICS™ model RSBC pressure sequencing valve manufactured by Sun Hydraulics Corporation, Sarasota, Fla., United States of America. More preferably, the flow control valve 22*c* is a SUN HYDRAULICS™ model FBDA flow control valve also manufactured by Sun Hydraulics Corporation.

The addition of the sequence valve 22*s* and flow control valve 22*c* allow the system 10 to utilize a higher capacity hydraulic pump 18 than might otherwise be possible without prematurely triggering the pressure sensor 22*p* and/or without requiring higher rated tubing 30 and 32 and other hydraulic components (e.g. all tubing and components rate to 5000 psi). Premature triggering of the pressure sensor 22*p* results in only partially stroking the downhole pump 12, while using higher pressure rated tubing and components add to the overall expense of the system 10.

For example, the inventor observed that with the power unit 29 of this embodiment, for a well 14 having a depth of 1000 meters or greater and with the sequence valve set to open at 2800 psi and the flow control valve 22*c* set to pass flow greater than 3 U.S. gallons per minute (>3 gpm), it is possible to utilize a 5 U.S. gallons per minute (5 gpm) hydraulic pump 18 without prematurely triggering the pressure sensor 22*p*.

In such case, and during the intake stroke of the down-hole pump 12, all of the hydraulic pump's 18 output (i.e. all 5 gpm) is initially diverted (through valve 22*f*) to the down-hole pump 12; up until such time as when the hydraulic fluid's pressure reaches 2800 psi. Once this 2800 psi pressure is reached, the sequence valve 22*s* opens and diverts flow to the control valve 22*c*, which will only pass flow A in excess of the 3 gpm back to the reservoir 26. The remaining, and slower, flow rate of 3 gpm allows the hydraulic pressures to translate the distance down the conduit 32 to the down-hole pump 12 without prematurely triggering the pressure sensor 22*p* (as might otherwise be the case when using higher flow rates). Advantageously, the system 10 is therefore able to quickly "pressure up" to the desired 2800 psi pressure, thereby reducing overall pump stroke time of the system 10.

Those of ordinary skill in the art will appreciate that various modifications to the invention as described herein will be possible without falling outside the scope of the invention.

I claim:

1. A down-hole pump, for use in a wellbore comprising:
- a cylindrical housing suitable for insertion into the wellbore and having a first end adapted to connect to a down-hole end of a tubular member, a second opposing end, a hydraulic chamber and a produced fluid chamber;
- a passage in the hydraulic chamber for fluid communications with a hydraulic conduit;
- an inlet and an outlet in the produced fluid chamber, said inlet located closer to the second end than to the first end;
- a first check valve associated with the inlet;
- a second check valve associated with the outlet;
- a stored energy unit;
- a piston having a first side exposed to the stored energy unit and a second side exposed to the hydraulic chamber; and
- a displacement member projecting from said piston into the produced fluid chamber.

2. The down-hole pump of claim 1 wherein the displacement member is a rod and further comprising a rod seal to separate the hydraulic chamber from the produced fluid chamber and wherein the rod projects through the rod seal into the produced fluid chamber.

3. The down-hole pump of claim 2 wherein the piston is the sole piston of the down-hole pump.

4. The down-hole pump of claim 3 wherein the stored energy unit comprises a gas.

5. A pump to pump a first fluid and to be powered by a second fluid, the pump comprising:
- a first chamber having a passage for fluid communications with a hydraulic conduit, wherein said hydraulic conduit carries the second fluid;
- a second chamber having an inlet and an outlet to, respectively, receive and discharge the first fluid;
- a first check valve associated with the inlet suitable to allow the first fluid to enter the second chamber through the inlet and further suitable to prevent the first fluid from exiting the second chamber through the inlet;
- a second check valve associated with the outlet suitable to allow the first fluid to exit the second chamber through the outlet and further suitable to prevent the first fluid from entering the second chamber through the outlet;
- a stored energy unit;

a piston, having one side exposed to the stored energy unit and a second side exposed to the first chamber; and a displacement member projecting from said piston into the second fluid chamber, said displacement member moveable with said piston;

wherein the displacement member is sufficient to effect positive and negative displacement strokes within the second fluid chamber as said displacement member is reciprocated therewithin.

6. The down-hole pump of claim 5 wherein the displacement member is a rod and further comprising a rod seal to separate the first chamber from the second chamber and wherein the rod projects through the rod seal into the second chamber.

7. The down-hole pump of claim 6 wherein the piston is the sole piston of the down-hole pump.

8. The down-hole pump of claim 7 wherein the stored energy unit comprises a gas.

* * * * *